United States Patent [19]

Sakamoto et al.

[11] Patent Number: 5,018,990

[45] Date of Patent: May 28, 1991

[54] FILTER CONNECTOR

[75] Inventors: Yukio Sakamoto; Iwao Fukutani; Toshio Hori, all of Nagaokakyo, Japan

[73] Assignee: Murata Manufacturing Co., Ltd., Nagaokakyo, Japan

[21] Appl. No.: 457,564

[22] Filed: Dec. 27, 1989

[30] Foreign Application Priority Data

Dec. 28, 1988 [JP] Japan ..... 63-331898

[51] Int. Cl.[5] ..... H01R 13/66

[52] U.S. Cl. ..... 439/620

[58] Field of Search ..... 439/607, 620; 333/183

[56] References Cited

U.S. PATENT DOCUMENTS 3,648,222 3/1972 Cowmeadow ..... 439/620 X

FOREIGN PATENT DOCUMENTS 2309996 11/1976 France ..... 439/620

*Primary Examiner*—Eugene F. Desmond

*Attorney, Agent, or Firm*—Burns, Doane, Swecker & Mathis

[57] ABSTRACT

A filter connector comprising a housing, connector terminals mounted on the housing, filter elements mounted around the connector terminals, and a support plate for supporting the filter elements as being mounted on the housing. The support plate has pairs of elastic flaps which are formed at the positions corresponding to each of the filter elements, the free end of each flap holds the external surface of each filter element to prevent destruction of the filter elements attributable to the difference in the thermal expansion coefficients of materials.

4 Claims, 4 Drawing Sheets

FILTER CONNECTOR

BACKGROUND OF THE INVENTION

1. Field of the Invention

The present invention relates to a filter connector, and more particularly to a support construction of a filter element therein.

2. Description of Related Art

It is known that a conventional filter connector has a construction as illustrated in FIG. 7. The filter connector 1 comprises a housing 2 which is made of an insulating resin material and formed in an elongated shape having a rectangularly-bent section shape, and a plurality of connector terminals 3 which are mounted apart at a specified distance in the lengthwise direction (the direction perpendicular to the surface of FIG. 7) of the upper portion 2*a*. Around each of the connector terminals 3 is provided a through capacitor 4 whose internal electrode is fixed thereto by means of soldering.

Each through capacitor 4 is fixed to a ground (support) plate 8 made of a metal material in a manner where the stepped portion 7 which is located between a small-diameter portion 5 and a larger-diameter portion 6 of the exterior of the through capacitor 4 is pressed by the upper portion 8*a* of the ground plate 8 which is formed in an elongated shape having a rectangularly-bent section shape. Around each through capacitor 4 is provided an external electrode as being fixed to the ground plate 8 by means of soldering. Both the lateral free ends 8*b* of the ground plate 8 are formed to have reversed bent edges 8*c* are engaged with corresponding notches 2*c* provided at either side portion 2*b* of the housing 2. Ordinarily, the soldering between the internal electrodes of the through capacitors 4 and the connector terminals 3, and the soldering between the external electrodes of the through capacitors 4 and the ground plate 8 are performed at the same time.

In the above-mentioned conventional filter connector 1, despite the fact that there is a significant difference between the thermal expansion coefficient of the housing 2 made of a resin material and that of the ground plate 8 made of a metal material, the through capacitors 4 are firmly fixed to both of them. This means that the through capacitors 4 hinder the mutual displacement between the resin housing 2 and the metal ground plate 8 despite the fact that such mutual displacement occurs due to the difference in the thermal contraction or expansion rate. Therefore, the hindrance of mutual displacement incurs the generation of internal deformation force in the through capacitors 4, which also results in such a problem that the electrodes of the through capacitors 4 come off, or sometimes the through capacitors 4 themselves are destroyed.

SUMMARY OF THE INVENTION

In view of the above-mentioned conventional problems, the present invention was made to have an object of providing a novel filter connector capable of securely absorbing the deforming force attributable to the difference in the thermal expansion coefficients of several types of materials used to effectively prevent the possible destruction of the filter elements.

In order to attain the object above, a filter connector according to the present invention comprises a housing, a connector terminal mounted on the housing, a filter element mounted around the connector terminal, and a support plate for supporting the filter element as being mounted on the housing, wherein the support plate has an elastic flap which is formed at the position corresponding to the filter element, the free end of the flap holds the external surface of the filter element.

According to the above construction, the external surface of filter element mounted on the housing via the corresponding connector terminal is not fixed to the support plate, in other words, the filter element and the connector terminal are merely placed in contact with the support plate via the flap. Therefore, when there occurs a mutual displacement of the housing and the support plate due to the difference in their thermal characteristics causing an expansion or contraction, the accompanying displacement of the filter element is not hindered by the support plate. As a consequence, the filter element can move freely in the lengthwise direction of the connector terminal. For the above reasons, there is applied no distorting force attributable to the difference in the thermal expansion or contraction rate of the housing and the support plate onto the filter element mounted on the housing via the connector terminal. As a result, the distortion factor attributable to the difference of the materials of the housing and the support plate is effectively eliminated, which also results in preventing the possible destruction of the filter element.

BRIEF DESCRIPTION OF THE DRAWINGS

These and other objects and features of the present invention will become apparent from the following description taken in conjunction with the preferred embodiments thereof with reference to the accompanying drawings in which:

FIG. 2 is a lateral sectional view of the filter connector;

FIG. 2 is a plan view of the essential portion of the filter connection;

FIG. 3 is a perspective rear view of the essential portion of a ground plate;

FIG. 4 is a perspective rear view of a modification of the ground plate;

DETAILED DESCRIPTION OF THE PREFERRED EMBODIMENTS

The following describes the preferred embodiments according to the present invention with reference to the accompanying drawings.

[First Embodiment, Refer to FIGS. 1 through 4]

Figure 1:
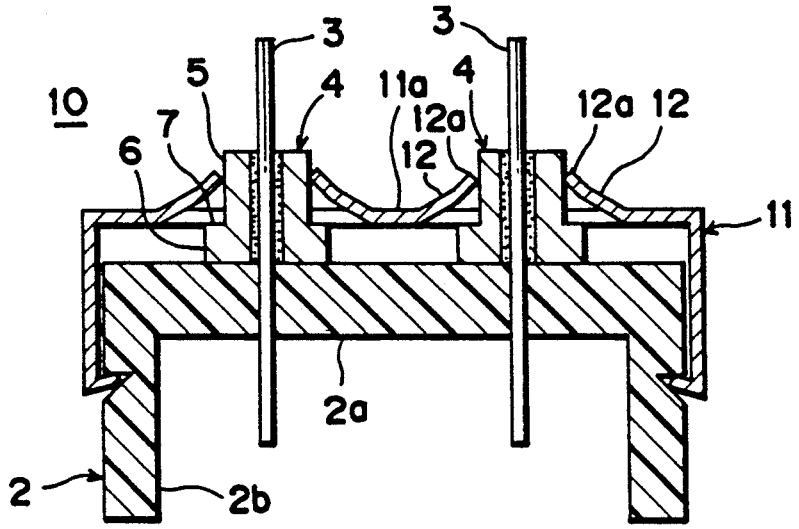
FIG. 1 through FIG. 4 show a first embodiment of a filter connector according to the present invention.
Figure 2:
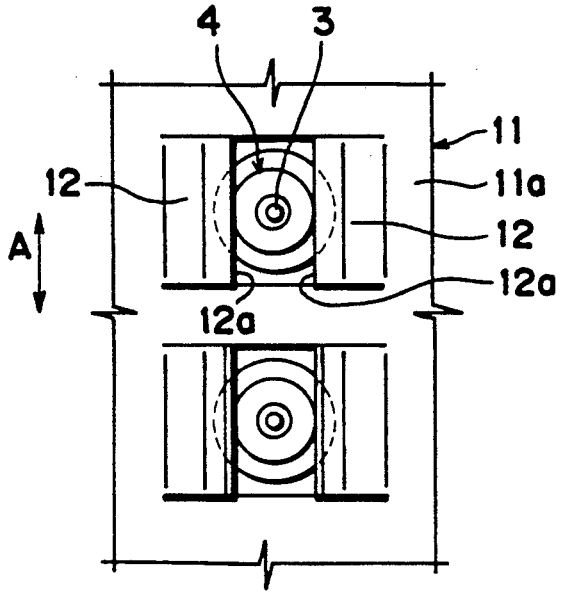

In FIGS. 1 through 4, the numeral 10 denotes a filter connector, and the numeral 11 denotes a ground (support) plate. It is noted that the basic construction of the filter connector 10 is not substantially different form the aforesaid conventional filter connector 1 except for the ground plate 11, therefore the same or corresponding parts or portions in FIGS. 1 and 2 are denoted by the same numerals as given in FIG. 6, and no detailed description is provided here. It is further noted that the following description is for a filter connector where a plurality of connector terminals are provided apart in the lengthwise direction (the direction perpendicular to the surface of FIG. 1), however the present invention also covers a filter connector having a single connector terminal.

The filter connector 10 comprises a housing 2 which is made of an insulating resin material and formed in an elongated shape, a plurality of connector terminals 3 which are provided apart at a specified distance in the lengthwise direction (the direction perpendicular to the surface of FIG. 1) of the housing 2, through capacitors 4 each of which is provided around each of the connector terminals 3 arbitrarily by means of soldering to serve as filter elements, and a ground plate 11 which is provided on the housing 2 to totally support the through capacitors 4. It is noted that FIG. 1 shows the filter connector 10 where the connector terminals 3 are arranged in two lines in the lengthwise direction of the housing 2, however the connector terminals 3 may also be arranged in one line.

Figure 3:
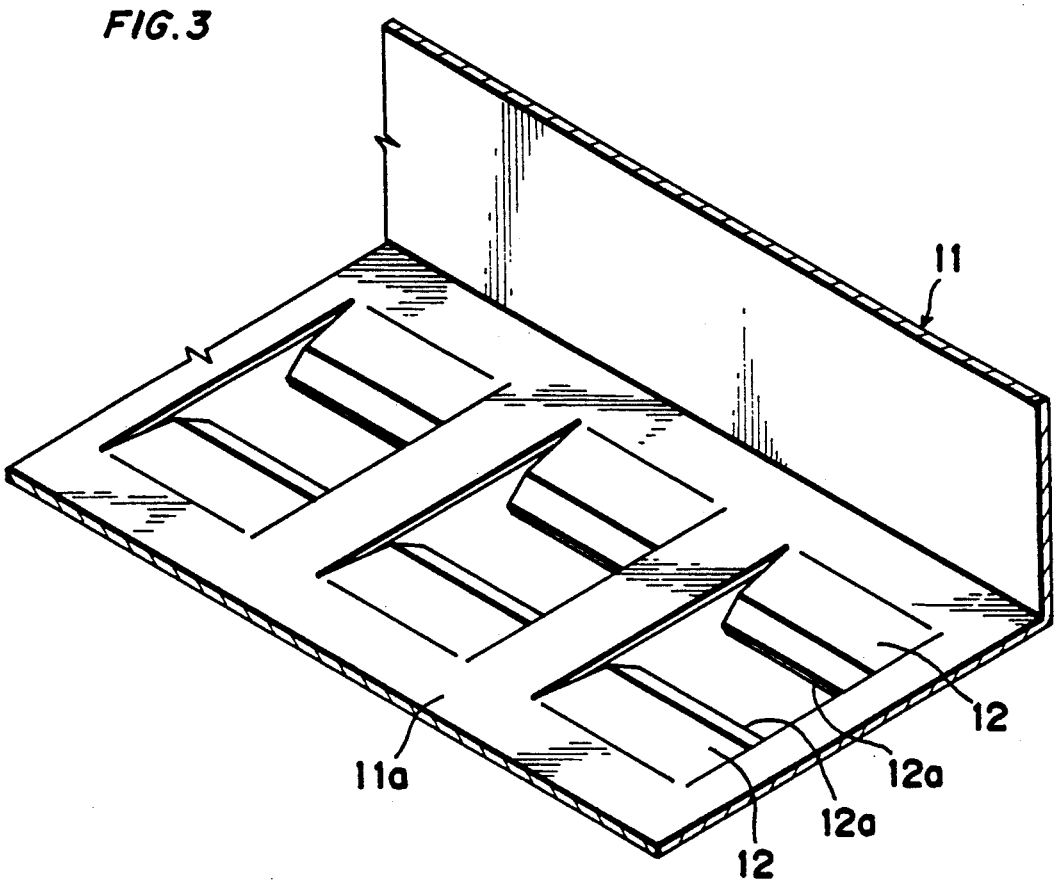
Figure 4:
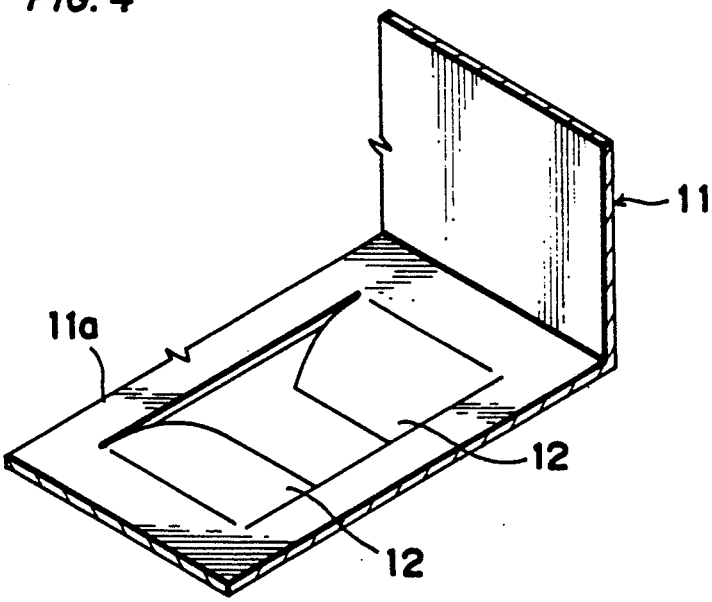

The ground plate 11 is formed in an elongated shape having a rectangularly-bent section shape, and certain portions of the upper portion 11*a* thereof corresponding to the through capacitors 4 are processed to have flaps 12 and 12 as shown in FIG. 3 and raised outward (downward in FIG. 3) to be elastically deformable. The flaps 12 and 12 are arranged in such a manner that a pair of flaps 12 and 12 are provided for one capacitor reception hole with the free ends 12*a* and 12*a* thereof laterally facing each other in the lengthwise direction of the ground plate 11. Although it is described that each flap 12 has a linear section shape except for the bent portion located at the middle portion between the base portion and the free end portion, the shape of the flap 12 is not limited to the linear shape. For example, the flap 12 may have a section shape curved from the base portion to the free end portion as illustrated in FIG. 4. Further, the flap 12 may have a linear section only.

When the above-mentioned ground plate 11 is mounted on the housing 2, the space between each pair of the flaps 12 and 12 provided in the ground plate 11 are expanded against the elasticity thereof by the corresponding through capacitor 4 mounted via each connector terminal 3. As a consequence, the small-diameter portion 5 of each through capacitor 4 is pinched by the free ends 12*a* and 12*a* with the elastic force from the flaps 12 and 12 in the direction perpendicular to the lengthwise direction of the ground plate 11. This also results in an electrically-connected relationship between the external electrode formed around the small-diameter portion 5 of each through capacitor 4 and the ground plate 11 via the corresponding pair of the flaps 12 and 12.

In more detail, the external electrode of each through capacitor 4 is not fixed to the ground plate 11, i.e. they are placed in contact merely by the elasticity of the flaps 12 and 12 of the ground plate 11. Therefore, the mutual displacement attributable to the thermal expansion or contraction of the housing 2 and the ground plate 11 taking place due to the difference in their thermal characteristics are effectively absorbed. Usually the housing 2 has a thermal expansion rate greater than that of the ground plate 11, therefore the small-diameter Portion 5 of each through capacitor 4 slides in the space between the free ends 12*a* and 12*a* of the corresponding pair of flaps 12 and 12. As a consequence, the displacement of each through capacitor 4 is not hindered by the ground plate 11, therefore each through capacitor 4 can freely move in the lengthwise direction (as indicated by the arrow "A" in FIG. 2) of the filter connector 10.

Figure 5:
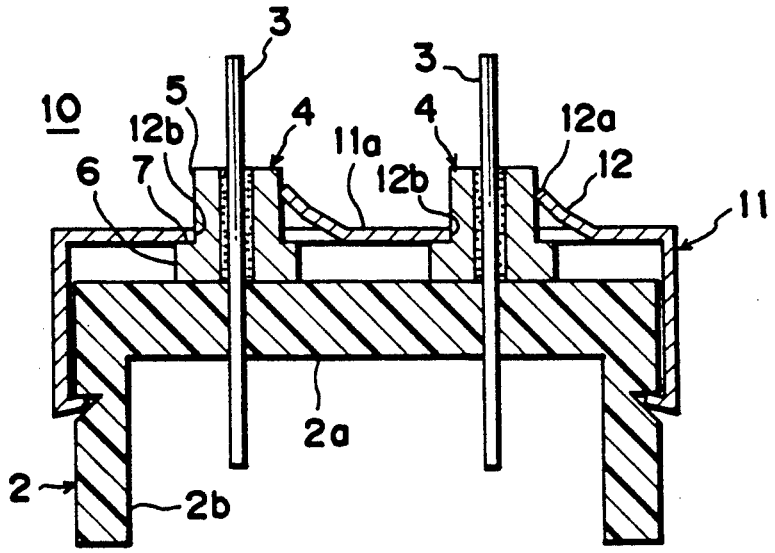
FIG. 5 is a lateral sectional view of a second embodiment of a filter connector according to the present invention.
Figure 7:
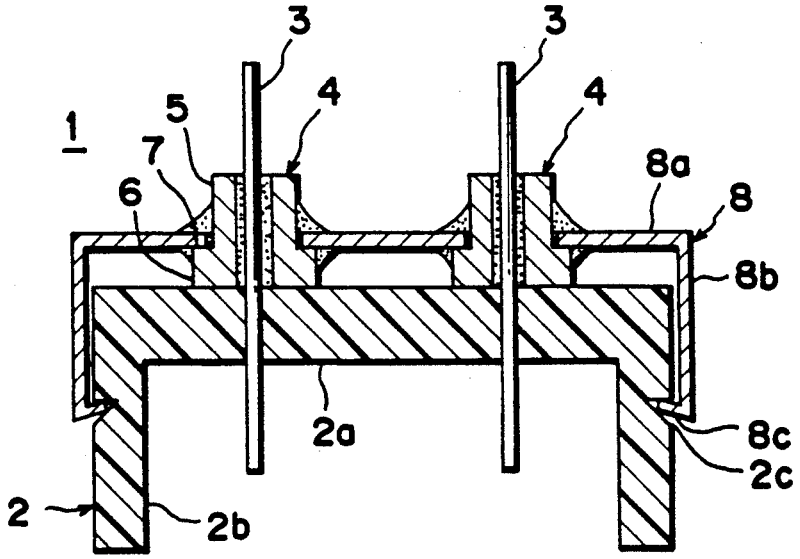
FIG. 7 Prior Art
FIG. 7 is a lateral sectional view of the construction of a conventional filter connection.

[Second Embodiment, Refer to FIG. 5]

FIG. 5 shows a second embodiment of a filter connector according to the present invention where a single flap 12 is formed in the ground plate 11 for each through capacitor 4. Each through capacitor 4 is held by the free end 12*a* and the edge portion 12*b* of a reception hole.

Figure 6:
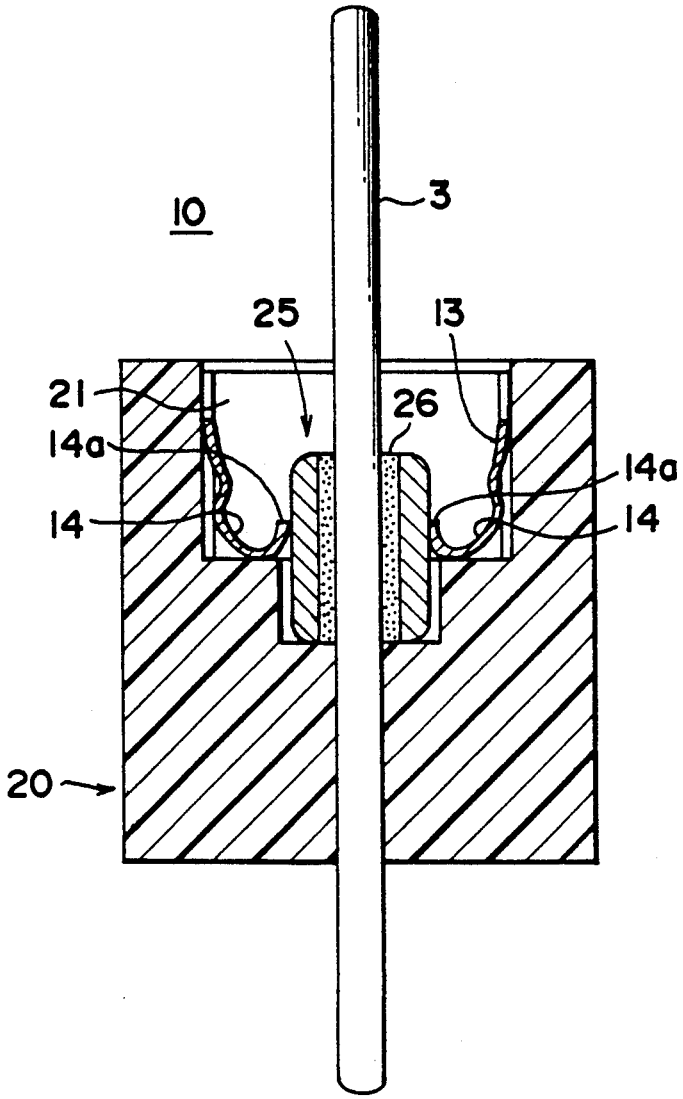
FIG. 6 is a lateral sectional view of a third embodiment of a filter connector according to the present invention.

[Third Embodiment, Refer to FIG. 6]

FIG. 6 shows a third embodiment of a filter connector according to the present invention. The filter connector 10 comprises a housing 20 which is made of an insulating resin material and formed in an elongated shape, a plurality of connector terminals 3 which are provided apart at a specified distance in the lengthwise dIrection (the direction perpendicular to the surface of FIG. 6) of the housing 20, ferrite beads 25 each of which is provided in a groove 21 of the housing 20 and around each of the connector terminals 3 by an insulating binder 26 to serve as filter elements, and a support plate 13 which is provided in the groove 21 to totally support the ferrite beads 25.

The support plate 13 is formed in an elongated shape, and certain portions of the both sides thereof corresponding to the ferrite beads 25 are processed to have flaps 14 and 14. The peripheral surface of each ferrite beads 25 is pinched by the free ends 14*a* and 14*a* with the elastic force from the flaps 14 and 14 in the direction perpendicular to the lengthwise direction of the support plate 13.

Additionally, in the structure of the third embodiment, the through capacitors 3 shown in FIGS. 1 and 5 may be used instead of the ferrite beads 25.

Although the present invention has been described in connection with the preferred embodiments thereof, it is to be noted that various changes and modifications are apparent to those who are skilled in the art. Such changes and modifications are to be understood as included within the scope of the present invention as defined by the appended claims, unless they depart therefrom.

What is claimed is:

1. A filter connector comprising:

a housing;

a connector terminal mounted on said housing;

a filter element mounted around said connector terminal; and, a support plate for supporting said filter element as being mounted on said housing, wherein said support plate is extended in a lengthwise direction of said housing and has an elastic flap which is formed at the position corresponding to said filter element, and a free end of said flap holds an external surface of said filter element in a direction perpendicular to the lengthwise direction of said support plate and wherein said filter element is movable relative to the support plate in a lengthwise direction of the housing.

2. A filter connector as claimed in claim 1, wherein said flap is raised at the position corresponding to said filter element.

3. A filter connector as claimed in claim 1, wherein said filter element is a through capacitor.

4. A filter connector as claimed in claim 1, wherein said filter element is a ferrite bead.

* * * * *